US005870013A

United States Patent [19]

Van Der Grijn et al.

[11] Patent Number: 5,870,013

[45] Date of Patent: Feb. 9, 1999

[54] THERMALLY CONTROLLED ELECTRICAL SWITCHING DEVICE HAVING A SNAP-ACTION SWITCH

[75] Inventors: Adriaan Van Der Grijn; Sikke Havinga, both of Drachten, Netherlands

[73] Assignee: U.S. Philips Corporation, New York, N.Y.

[21] Appl. No.: 541,382

[22] Filed: Oct. 10, 1995

[30] Foreign Application Priority Data

Oct. 10, 1994 [EP] European Pat. Off. ..... 94202921

[51] Int. Cl.[6] ..... H01H 37/52; H01H 37/74

[52] U.S. Cl. ..... 337/343; 337/333; 337/379; 337/111

[58] Field of Search ..... 337/342, 343, 337/365, 375, 89, 111, 333, 379

[56] References Cited

U.S. PATENT DOCUMENTS

| | | | |
|---|---|---|---|
| 3,170,998 | 2/1965 | Stahl | 337/368 |
| 4,254,313 | 3/1981 | Baader | 200/452 |
| 4,507,642 | 3/1985 | Blackburn | 337/89 |
| 5,111,010 | 5/1992 | Kokubu et al. | 200/461 |

FOREIGN PATENT DOCUMENTS 2211353 6/1989 United Kingdom .

*Primary Examiner*—Leo P. Picard
*Assistant Examiner*—Jayprakash N. Gandhi
*Attorney, Agent, or Firm*—Ernestine C. Bartlett

[57] ABSTRACT

The invention relates to a thermally controlled electrical switching device including a temperature control (1) having a snap-action switch (2) including a fixed contact (4) and a movable contact (3) connected to a metal snap-action switching spring (9), and having a bimetallic element (5) which influences the movement of the movable contact. In order to minimize the heat produced in the mechanically loaded parts (17, 18) of the snap-action switching spring (9) the switching devices limits the current through these mechanically loaded parts. These devices may include an electrically well conductive layer (30) provided on the non-mechanically loaded parts of the snap-action switching spring or a layer (31) having a high electrical resistance deposited on the mechanically loaded parts (17, 18).

4 Claims, 2 Drawing Sheets

THERMALLY CONTROLLED ELECTRICAL SWITCHING DEVICE HAVING A SNAP-ACTION SWITCH

FIELD OF THE INVENTION

The invention relates to a thermally controlled electrical switching device comprising a temperature control having a snap-action switch comprising a fixed contact and a movable contact connected to a metal snap-action switching spring, a bimetallic element which influences the movement of the movable contact, which snap-action switching spring is formed by a strip having two U-shaped cut-outs which extend in the longitudinal direction of the strip and which are separated from one another by a bridge portion, the bases of the U-shaped cut-outs adjoining the bridge portion in such a manner that narrow edge portions are formed between the lateral edges of the strip and the limbs of the U and tongues are formed between the limbs of the U, which strip is bent at the location of the bridge portion in such a manner that one tongue is situated above the other tongue, and the free end portions of the tongues are pivotally coupled to one another.

BACKGROUND OF THE INVENTION

Such a switching device is known from GB-B-2,211,353. Snap-action switching springs of a switching device should have a satisfactory conductivity for electric current. However, the electric current generates heat in the switching springs. When such switching springs are used in appliances which in addition operate at a high ambient temperature, the heat produced in the switching is considerable, as result of which the total temperature of the switching spring becomes very high. The switching springs should therefore have an adequate creep strength to prevent relaxation. To this end the springs are manufactured from hardened chrome-nickel steel. However, such a material has a comparatively high specific resistance (approximately 730 nΩm), as a result of which the heat generation in the switching spring even increases. If the switching device is used in appliances such as flat-irons, which operate both with high current intensities and at a high ambient temperature, the resulting heat generation may lead to such a high temperature that it may give rise to creepage of, particularly, the mechanically loaded parts, specifically the bent tongue, which is under compressive stress. This causes the compressive stress to decrease, as a result of which the switching device no longer performs satisfactorily. For large current intensities the free end portions of the tongues, which are hooked together so as to be pivotal, may even become welded to one another, so that the spring is impeded in its movement and no longer performs its switching function.

SUMMARY OF THE INVENTION

It is an object of the invention to provide a switching device of the type defined in the opening paragraph, in which only a minimal heat generation occurs in the mechanically loaded parts of the snap-action switching spring during operation.

To this end, the switching device in accordance with the invention is characterized in that the device comprises means which limit the current through the tongues.

Limiting the current in the tongues precludes an excessive temperature rise of the tongues and thereby reduces the risk of relaxation of the spring steel. In particular, this reduces the generation of heat in the tongues, which are under bending stress, so that the above problems are avoided. This reduces the risk of malfunctioning or failure of the switching device. Obviously, the current should be limited in such a manner that the highest temperature of the switching spring remains below the relaxation temperature (approximately 330° C.) of spring steel.

In a first embodiment the means comprise an electrically conductive layer on the edge portions of the switching spring. The current will now pass mainly through this electrically well conductive layer and to a smaller extent through the parts which are provided with this layer, such as the mechanically loaded parts. Preferably, the electrically conductive layer is of copper. This copper layer may be applied, for example by means of an electrodeposition process or a rolling process, on the edge portions of the strip before the actual switching spring is formed by operations such as punching and bending. Alternatively, the electrically conductive layer may be of silver.

In a second embodiment the means are formed by providing the pivotably coupled free end portions of the tongues with a layer having an electrical resistance which is high in comparison with that of other parts of the snap-action switching spring. The layer may, for example, be of a ceramic material applied to the end portions of the tongues by means of customary processes such as sputtering or a sol-gel method.

In a third embodiment the means are formed by a flexible electrical connection between the fixed end portion and the movable end portion of the snap-action switching spring. The electric current now flows almost wholly through this flexible connection and no longer through the mechanically loaded switching spring. The connection must be flexible, because one of the ends of the flexible connection is connected to a movable part of the switching spring. The flexible connection may be, for example, a copper wire.

BRIEF DESCRIPTION OF THE DRAWINGS

The invention will now be described in more detail with reference to exemplary embodiments shown in the drawings.

DETAILED DESCRIPTION OF THE PREFERRED EMBODIMENTS

Figure 1:
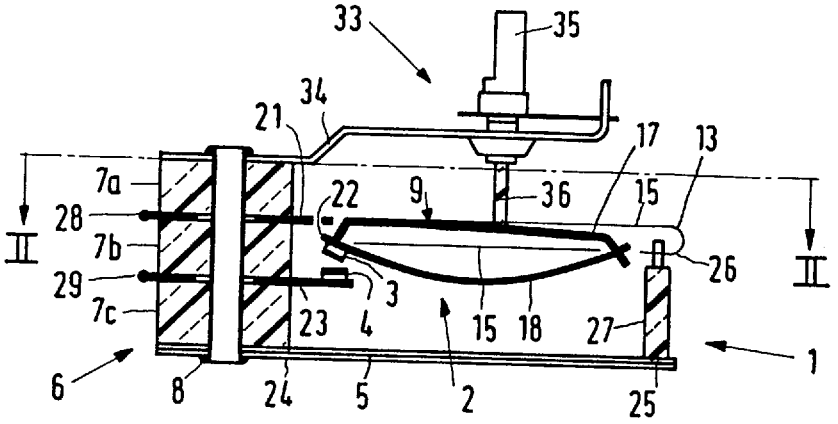
FIG. 1 is a cross-sectional view of the switching device.
Figure 2:
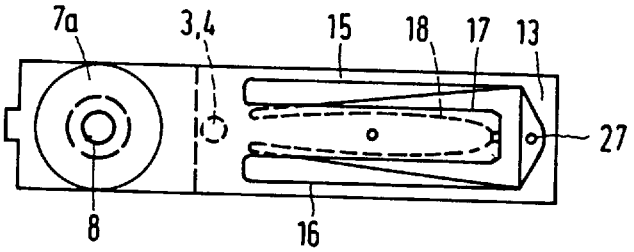
FIG. 2 is a cross-sectional view of the switching device, taken on the line II—II in FIG. 1.
Figure 3:
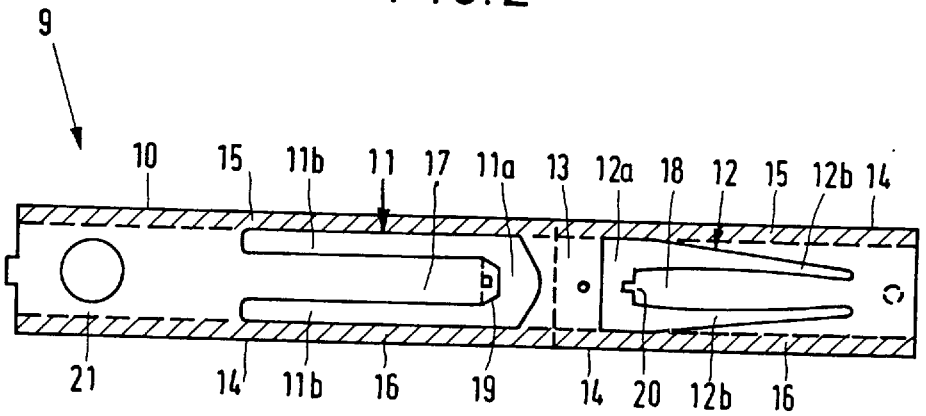
FIG. 3 shows the snap-action switching spring in extended form.

The thermally controlled electrical switching device comprises a temperature control 1, which mainly comprises a snap-action switch 2 having a movable contact 3, a fixed contact 4 and a bimetallic element 5. These parts are secured to a base 6 comprising three electrically insulated spacer rings 7*a*, 7*b*, 7*c* which are fastened to one another by means of a tubular rivet 8. The snap-action switch 2 comprises a snap-action switching spring 9, to which the movable contact is secured. The snap-action switching spring 9 is a spring-steel strip 10 which, as shown in FIG. 3, has two substantially U-shaped cut-outs 11, 12 extending in the longitudinal direction of the strip. These cut-outs are separated by a bridge portion 13 in such a manner that the bases 11*a*, 12*a* of both U-shaped cut-outs adjoin the bridge portion. This results in narrow edge portions 15–16 being formed between the lateral edges 14 of the strip 10 and the limbs 11*b*, 12*b* of the U and in tongues 17–18 being formed between the limbs of the U. At the location of the bridge portion 13 the strip is bent through approximately 180°, as a result of which one tongue 17 is situated above the other tongue 18. The free end portions 19–20 of the tongues are pivotally hooked into one another so as to give the tongue 18 a curved shape. The tongue 18 is then constantly under compressive stress. One end portion 21 of the snap-action switching spring 9 is secured between the insulated spacer rings 7*a*, 7*b* of the base 6, the movable contact 3 being secured to the other end portion 22. The fixed contact 4 is fastened to a ring 23, which is secured between the insulated spacer rings 7*b*, 7*c*. The fixed contact 4 faces the movable contact 3.

The end portion 24 of the bimetallic element 5 is secured to the spacer ring 7*c* of the base 6. An electrically insulated coupling pin 27 is clamped between the free end portion 25 of the bimetallic element 5 and the bent end portion 26 (near the bridge portion 13) of the snap-action switching spring 9 in order to transmit the deflection of the bimetallic element 5 to the snap-action switching spring 9. As a result of this, the snap-action switching spring is under a certain pre-load.

The switching device operates as follows: There is a voltage difference across the connection points 28 and 29 of the snap-action switching spring 9 to the movable contact 3 and of the ring 23 to the fixed contact 4, respectively. As long as the movable contact 3 is not in contact with the fixed contact 4 there will be no current through the snap-action switching spring. The bimetallic element 5 deflects downwards in the case of a temperature rise. This causes the compressive stress in the bent tongue 17 to change. At a given compressive stress the switching spring snaps over and the contacts 3 and 4 contact one another, as a result of which a current will flow through the snap-action switching spring. The process is reversed when the temperature decreases.

The current through the snap-action switching spring flows not only through the edge portions 15, 16 but also through the tongues 17, 18 via the pivotally coupled end portions 19, 20. The current through the tongues gives rise to a temperature rise of the tongues. As already explained, the temperature rise may become impermissibly high in the case of large currents. The temperature of the tongues is now prevented from becoming too high by limiting the current through the tongues.

Figure 4:
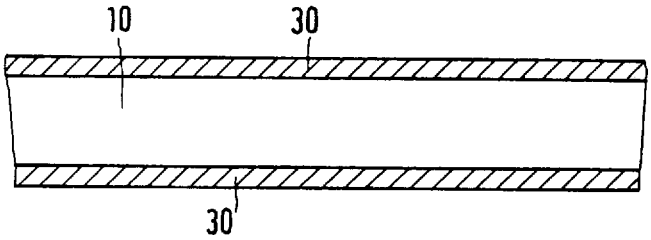
FIG. 4 shows the strip for the snap-action switching spring with copper-plated edge portions.

In a first embodiment (FIG. 4) this is achieved by coating the edge portions 15, 16 of the snap-action switching spring 9 with an electrically well conductive layer 30, for example a copper layer. Most of the current now passes through the copper layer and no longer through the tongues. Such a layer may already be applied to the strip 10 before operations such as punching and bending are performed. The layer can be applied, for example, by means of an electrodeposition process or a rolling process.

Figure 5:
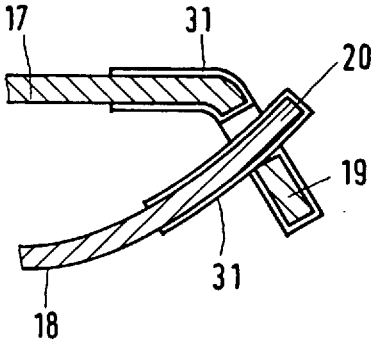
FIG. 5 shows the insulated end portions of the tongues of the snap-action switching spring.

In a second embodiment (FIG. 5) this is achieved by providing the pivotally coupled free end portions 19, 20 of the tongues with a layer having a high electrical resistance, for example a ceramic layer. Such a layer can be applied by means of sputtering or a sol-gel method or CVD (Chemical Vapor Deposition).

Figure 6:
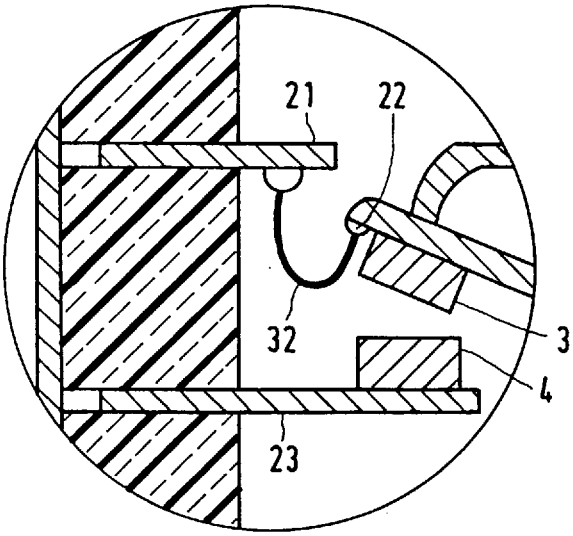
FIG. 6 shows a part of the switching device with a flexible electrical connection between the ends of the snap-action switching spring.

In a third embodiment (FIG. 6) this is achieved by providing a flexible electrical connection 32, for example a copper wire, between the fixed end portion 21 and the movable end portion 22 of the snap-action switching spring 9. The current will now flow almost wholly through the copper wire and no longer through other parts of the snap-action switching spring. However, in practice, the copper wire can only be fitted in the assembled condition of the switching device, for example by soldering. The switching device further comprises a control element 33 for setting the temperature. The control element is secured to a support 34, which in its turn is secured to the spacer ring 7*a* of the support 6. The temperature-control element 33 has a rotary knob 35, to which an insulated pin 36 is secured. One end of the pin 36 presses against the tongue 17 of the snap-action switching spring 9. The pin 36 can be adjusted in height by turning the rotary knob 35, which enables the pre-load on the tongues 17–18 to be adjusted. This pre-load influences the snap action of the tongue 18 with the movable contact 3.

We claim:

1. A thermally controlled electrical switching device comprising a temperature control having a snap-action switch comprising a fixed contact and a movable contact connected to a metal snap-action switching spring, a bimetallic element which influences the movement of the movable contact, which snap-action switching spring is formed by a strip having two U-shaped cut-outs with bases and limbs, which cut-outs extend in the longitudinal direction of the strip and are separated from one another by a bridge portion, the bases of the U-shaped cut-outs adjoining the bridge portion in such a manner that narrow edge portions are formed between the lateral edges of the strip and the limbs of the U-shaped cutouts and tongues are formed between the limbs of the U-shaped cutouts, which strip is bent at the location of the bridge portion in such a manner that one tongue is situated above the other tongue, and the free end portions of the tongues are pivotally coupled to one another, wherein the device comprises means which limit the current through the tongues.

2. A thermally controlled electrical switching device comprising a temperature control having a snap-action switch comprising a fixed contact and a movable contact connected to a metal snap-action switching spring, a bimetallic element which influences the movement of the movable contact, which snap-action switching spring is formed by a strip having two U-shaped cut-outs with bases and limbs, which cut-outs extend in the longitudinal direction of the strip and are separated from one another by a bridge portion, the bases of the U-shaped cut-outs adjoining the bridge portion in such a manner that narrow edge portions are formed between the lateral edges of the strip and the limbs of the U-shaped cutouts and tongues are formed between the limbs of the U-shaped cutouts, which strip is bent at the location of the bridge portion in such a manner that one tongue is situated above the other tongue, and the free end portions of the tongues are pivotally coupled to one another, wherein the device comprises an electrically conductive layer on the edge portions of the switching spring which limits the current through the tongues.

3. A thermally controlled electrical switching device comprising a temperature control having a snap-action switch comprising a fixed contact and a movable contact connected to a metal snap-action switching spring, a bimetallic element which influences the movement of the movable contact, which snap-action switching spring is formed by a strip having two U-shaped cut-outs with bases and limbs, which cut-outs extend in the longitudinal direction of the strip and are separated from one another by a bridge portion, the bases of the U-shaped cut-outs adjoining the bridge portion in such a manner that narrow edge portions are formed between the lateral edges of the strip and the limbs of the U-shaped cutouts and tongues are formed between the limbs of the U-shaped cutouts, which strip is bent at the location of the bridge portion in such a manner that one tongue is situated above the other tongue, and the free end portions of the tongues are pivotally coupled to one another, wherein the device comprises pivotally coupled free end portions of the tongues provided with a layer having an electrical resistance which is high in comparison with that of other parts of the snap-action switching spring, said end portions limiting the current through the tongues.

4. A thermally controlled electrical switching device comprising a temperature control having a snap-action switch comprising a fixed contact and a movable contact connected to a metal snap-action switching spring, a bimetallic element which influences the movement of the movable contact, which snap-action switching spring is formed by a strip having two U-shaped cut-outs with bases and limbs, which cut-outs extend in the longitudinal direction of the strip and are separated from one another by a bridge portion, the bases of the U-shaped cut-outs adjoining the bridge portion in such a manner that narrow edge portions are formed between the lateral edges of the strip and the limbs of the U-shaped cutouts and tongues are formed between the limbs of the U-shaped cutouts, which strip is bent at the location of the bridge portion in such a manner that one tongue is situated above the other tongue, and the free end portions of the tongues are pivotally coupled to one another, wherein the device comprises a flexible electrical connection between the fixed end portion and the movable end portion of the snap-action switching spring which limits the current through the tongues.

* * * * *